US009854909B1

(12) United States Patent
Chiu

(10) Patent No.: US 9,854,909 B1
(45) Date of Patent: Jan. 2, 2018

(54) BI-DIRECTIONAL POSITIONING SLIDING RAIL ASSEMBLY

(71) Applicant: Nan Juen International Co., Ltd., New Taipei (TW)

(72) Inventor: I-Hsiang Chiu, New Taipei (TW)

(73) Assignee: Nan Juen International Co., Ltd., New Taipei ( * ) Notice: Subject to any disclaimer, the term of this patent is extended or adjusted under 35 U.S.C. 154(b) by 0 days.

(21) Appl. No.: 15/224,550

(22) Filed: Jul. 30, 2016

(51) Int. Cl.

| | |
|---|---|
| ***A47B 88/04*** | (2006.01) |
| ***A47B 88/10*** | (2006.01) |
| ***A47B 88/00*** | (2017.01) |
| ***A47B 88/57*** | (2017.01) |
| ***A47B 88/493*** | (2017.01) |
| ***A47B 88/487*** | (2017.01) |

(52) U.S. Cl.
CPC ..... *A47B 88/57* (2017.01); *A47B 88/487* (2017.01); *A47B 88/493* (2017.01)

(58) Field of Classification Search
CPC ..... A47B 88/00; A47B 88/12; A47B 88/57; A47B 88/487; A47B 88/493; A47B 2088/4235; A47B 2210/0059
See application file for complete search history.

(56) References Cited

U.S. PATENT DOCUMENTS 6,457,790 B1 * 10/2002 Liang ..... A47B 88/493 312/333
6,851,774 B2 * 2/2005 Chen ..... A47B 88/467 312/334.44
6,935,710 B2 * 8/2005 Chen ..... A47B 88/487 312/333
6,945,619 B1 * 9/2005 Chen ..... A47B 88/487 312/334.44
7,108,340 B2 * 9/2006 Lai ..... A47B 88/57 312/333
7,156,477 B1 * 1/2007 Lu ..... A47B 88/57 312/333
7,604,309 B2 * 10/2009 Chen ..... A47B 88/487 312/333
7,658,457 B2 * 2/2010 Lu ..... A47B 88/57 312/333
7,731,312 B2 * 6/2010 Chen ..... A47B 88/57 312/333
7,744,175 B2 * 6/2010 Peng ..... A47B 88/493 312/333
7,794,031 B2 * 9/2010 Hsiung ..... A47B 88/57 312/333

(Continued)

*Primary Examiner* — Leslie A Nicholson, III
*Assistant Examiner* — Kimberley S Wright

(57) ABSTRACT

A bi-directional positioning sliding rail assembly includes a sliding rail set including an outer rail and an inner rail linearly slidably coupled together, an actuator mounted in the inner rail and providing a push member having opposing first push end and second push end, and a position-limiting mechanism mounted in the inner rail and including a first position-limiting member and a second position-limiting member that are pivotally connected to the inner rail and respectively disposed adjacent to the first push end and second push end of the push member and alternatively biasable relative to the inner rail by the actuator. Thus, the bi-directional positioning sliding rail assembly has the advantages of simple structure and ease of fabrication and use.

5 Claims, 11 Drawing Sheets

(56) References Cited

U.S. PATENT DOCUMENTS

| | | | | |
|---|---|---|---|---|
| 7,896,452 | B2 * | 3/2011 | Chang | A47B 88/493 312/333 |
| 8,528,999 | B2 * | 9/2013 | Chen | F16C 29/005 312/333 |
| 8,733,864 | B2 * | 5/2014 | Chen | A47B 88/493 312/333 |
| 9,066,590 | B2 * | 6/2015 | Wu | A47B 88/04 |
| 9,301,609 | B2 * | 4/2016 | Muller | A47B 88/04 |
| 2003/0141791 | A1 * | 7/2003 | Dubon | H05K 7/1421 312/333 |
| 2004/0174100 | A1 * | 9/2004 | Chen | A47B 88/487 312/333 |
| 2005/0162052 | A1 * | 7/2005 | Chen | A47B 88/487 312/334.5 |
| 2017/0055708 | A1 * | 3/2017 | Chen | F16C 29/005 |
| 2017/0159710 | A1 * | 6/2017 | Chen | F16C 29/043 |

* cited by examiner

BI-DIRECTIONAL POSITIONING SLIDING RAIL ASSEMBLY

BACKGROUND OF THE INVENTION

1. Field of the Invention

The present invention relates to sliding rail technology and more particularly, to a bi-directional positioning sliding rail assembly, which has actuator and a position-limiting mechanism mounted on the inner rail of the sliding rail set thereof, enabling the actuator to move the position-limiting mechanism and to further achieve bi-directional positioning of the inner rail in the outer rail.

2. Description of the Related Art

In order to enable an inner rail of a sliding rail set to be bi-directionally positioned in an outer rail, U.S. Pat. No. 6,935,710 discloses a design entitled "Bi-directional retainer for a slide track assembly of drawers". This prior art design uses two shoulders 73 of the unlatching member 70 to push the engaging portions 514,514' of the retaining arms 51,51' so as to further bias the retaining arms 51,51', releasing engagement between the retaining arms 51,51' and the protrusion 61. However, this prior art design still has drawbacks as follows:

1. After the shoulders 73 pushed the engaging portions 514,514', the elastic member 52 forces the retaining arms 51,51' back to their previous position; however, when the shoulders 73 push the engaging portions 514,514', a friction force will be produced and, when pushing the retaining arms 51,51', the elastic member 52 should also push the unlatching member 70 back to its previous position; further, the moving direction of the unlatching member 70 and the direction of displacement of the retaining arms 51,51' are different, and therefore, it is not easy to move the unlatching member 70 and a friction force will also be produced when moving the unlatching member 70, causing the unlatching member 70 to get stuck.

2. The retaining arms 51,51' are respectively controlled by the respective unlatching members 70,90, the design of this control structure is complicated, resulting in complicated operation and high manufacturing cost.

3. The retaining arms 51,51' are simply stopped by the elastic member 52; when an excessive external force is applied to the first slide track 30, the retaining arms 51,51' can be forced out of position.

SUMMARY OF THE INVENTION

The present invention has been accomplished under the circumstances in view. It is therefore the main object of the present invention to provide a bi-directional positioning sliding rail assembly, which uses an actuator to move a first position-limiting member and a second position-limiting member of a position-limiting mechanism to further achieve bi-directional positioning of an inner rail in an outer rail, simplyfing the structure, wherein the elastic reset direction of the first position-limiting member and the second position-limiting member is same as the elastic reset direction of the actuator so that the actuator can be returned to its previous position after an operation.

It is another object of the present invention to provide a bi-directional positioning sliding rail assembly, which has the first position-limiting member and second position-limiting member of the position-limiting mechanism configured to provide a length greater than the width of the inner rail so that the first position-limiting member and the second position-limiting member can simply be biased in one direction that is reversed to the direction in which the first position-limiting member and the second position-limiting member are stopped in position, ensuring positive positioning and avoiding positioning failure.

To achieve these and other objects of the present invention, a bi-directional positioning sliding rail assembly comprises a sliding rail set, an actuator and a position-limiting mechanism. The sliding rail set comprises an outer rail and an inner rail movable in and out of the outer rail. The outer rail comprises a protruded abutment portion located near one end thereof at one lateral side and facing toward the inner rail. The inner rail comprises two upright sidewalls longitudinally extended along two opposite lateral sides thereof. The actuator is mounted in the inner rail of the sliding rail set to face toward the outer rail, comprising a base member, an extension member extended from one end of the base member and a push member protruded from a top surface of the extension member and defining a first push end and an opposing second push end. The position-limiting mechanism is mounted in the inner rail of the sliding rail set to face toward the outer rail, comprising a first position-limiting member, a second position-limiting member and a spring member. The first position-limiting member and the second position-limiting member each comprise a pivot-connection base, a stop block located at one side of the pivot-connection base and a position-limiting block located at an opposite side of the pivot-connection base. Further, the vertical distance between the stop block and the position-limiting block is shorter than the distance between the two upright sidewalls of the inner rail. Further, the straight line distance between the stop block and the position-limiting block is grater than the distance between the two upright sidewalls of the inner rail. Further, the pivot-connection base of the first position-limiting member and the pivot-connection base of the second position-limiting member are respectively pivotally connected to the inner rail and spaced from each other at a predetermined distance. Further, the distance between the stop block of the first position-limiting member and the stop block of the second position-limiting member is shorter than the distance between the position-limiting block of the first position-limiting member and the the position-limiting of the second position-limiting member. Further, the position-limiting block of the first position-limiting member and the position-limiting block of the second position-limiting member respectively face toward the first push end and second push end of the actuator. Further, the spring member has two opposite ends thereof respectively connected to the pivot-connection base of the first position-limiting member and the pivot-connection base of the second position-limiting member.

When the inner rail is inserted into the outer rail, the protruded abutment portion of the outer rail forces the stop block to bias the first position-limiting member and then to get in between the two stop blocks. Thereafter, the second push end of the actuator is forced to push the position-limiting block of the second position-limiting member and to further bias the second position-limiting member so that the protruded abutment portion can move over the second position-limiting member. On the contrary, when removing the inner rail out of the outer rail, the protruded abutment portion is forced to push the stop block of the second position-limiting member, thereby biasing the second position-limiting member, and thus, the protruded abutment portion can get into the space between the two stop blocks.

Thereafter, the first push end of the actuator is forced to push the position-limiting block of the first position-limiting member and to further bias the first position-limiting member, enabling the protruded abutment portion to move over the first position-limiting member.

DETAILED DESCRIPTION OF THE PREFERRED EMBODIMENT

Figure 1:
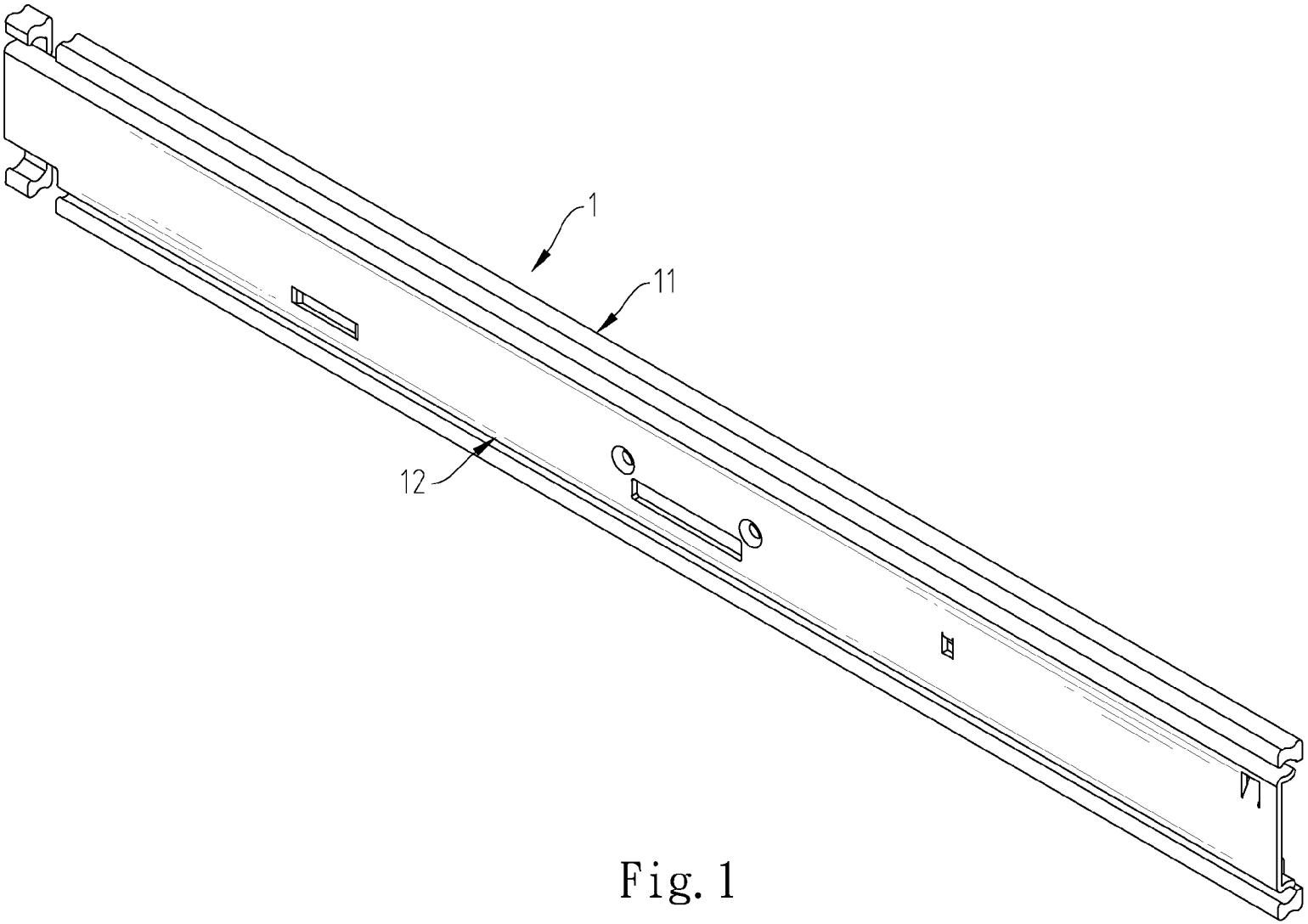
FIG. 1 is an oblique top elevational view of a bi-directional positioning sliding rail assembly in accordance with the present invention.
Figure 2:
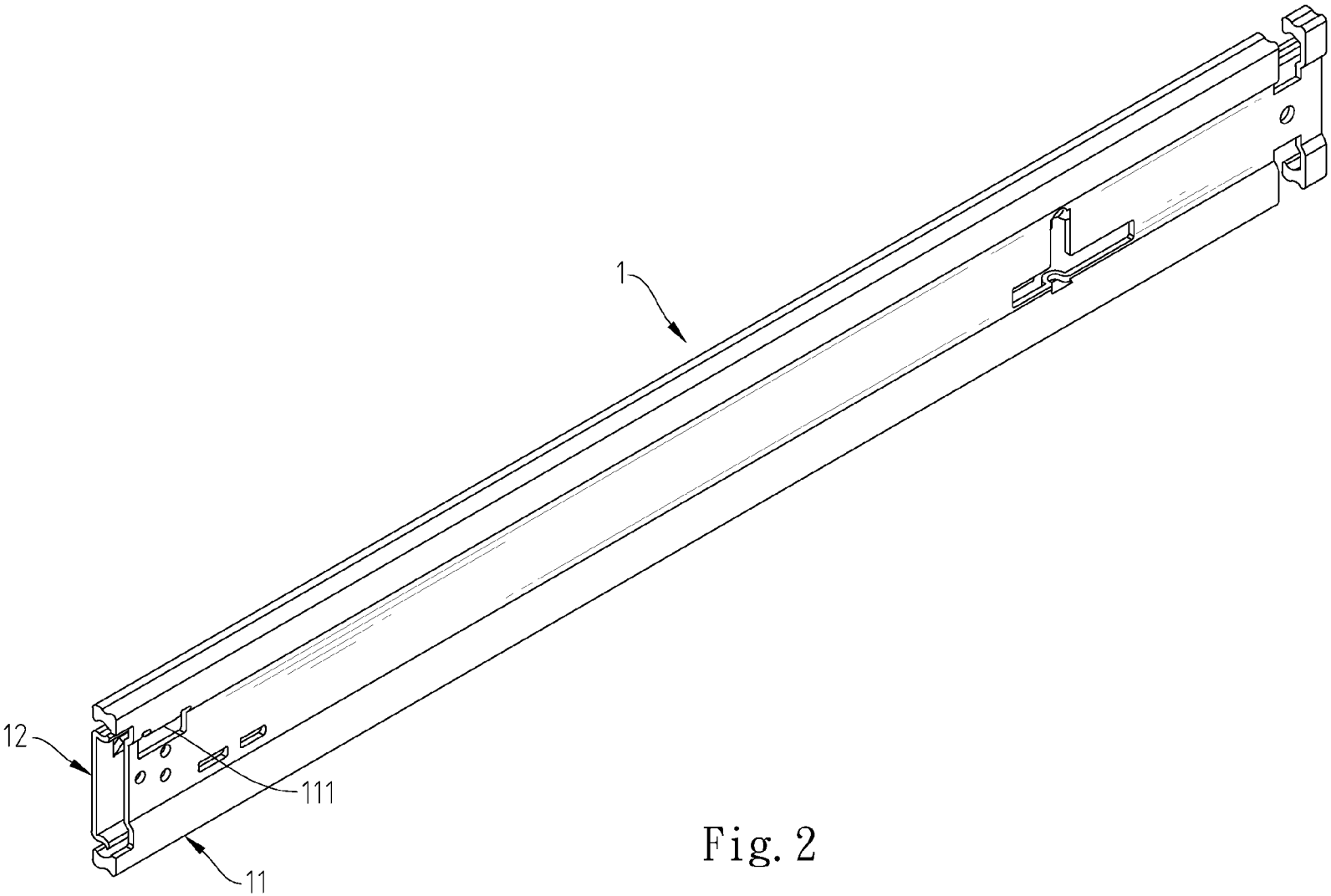
FIG. 2 corresponds to FIG. 1 when viewed from another angle.
Figure 3:
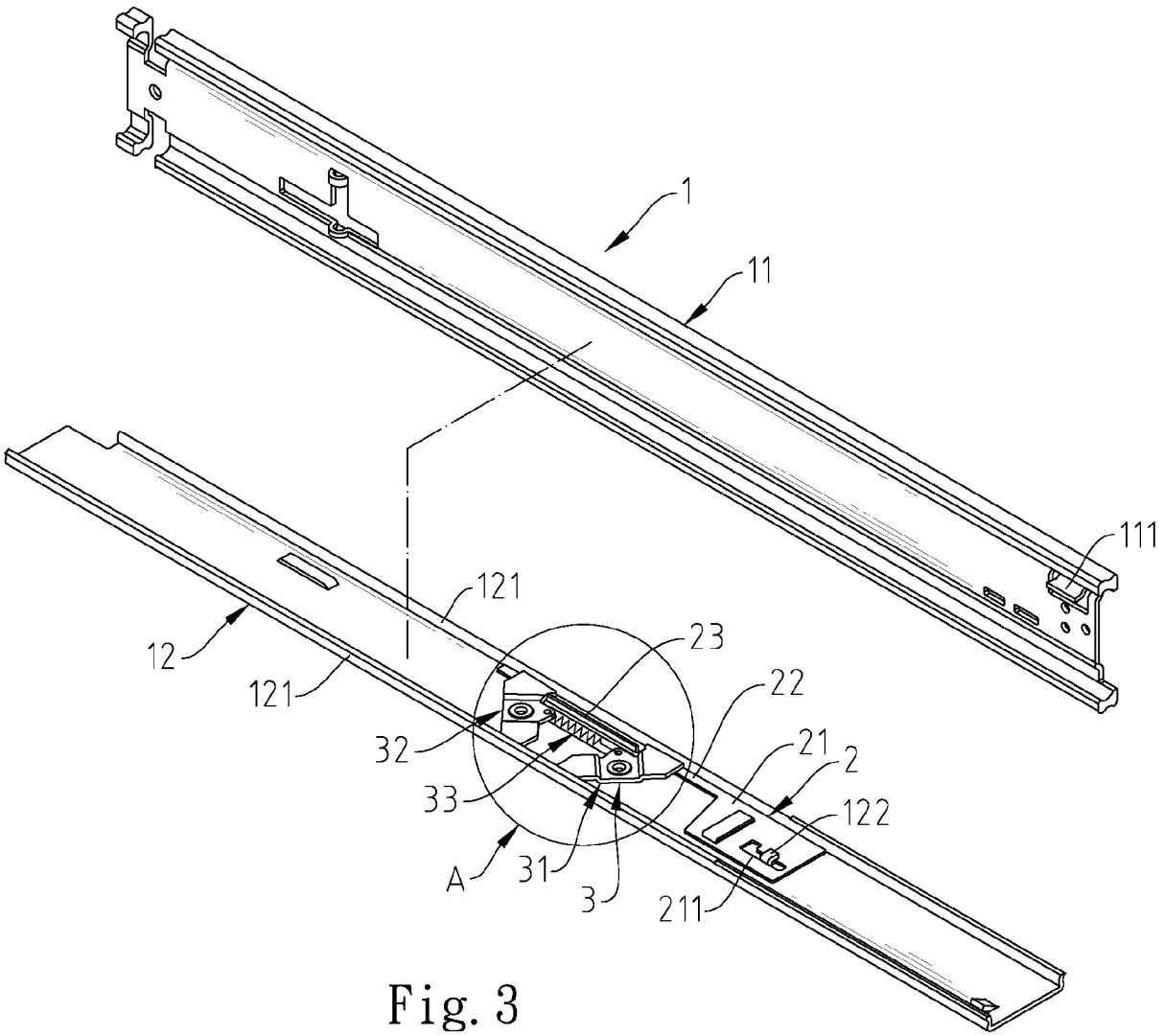
FIG. 3 is an exploded view of the bi-directional positioning sliding rail assembly in accordance with the present invention.
Figure 4:
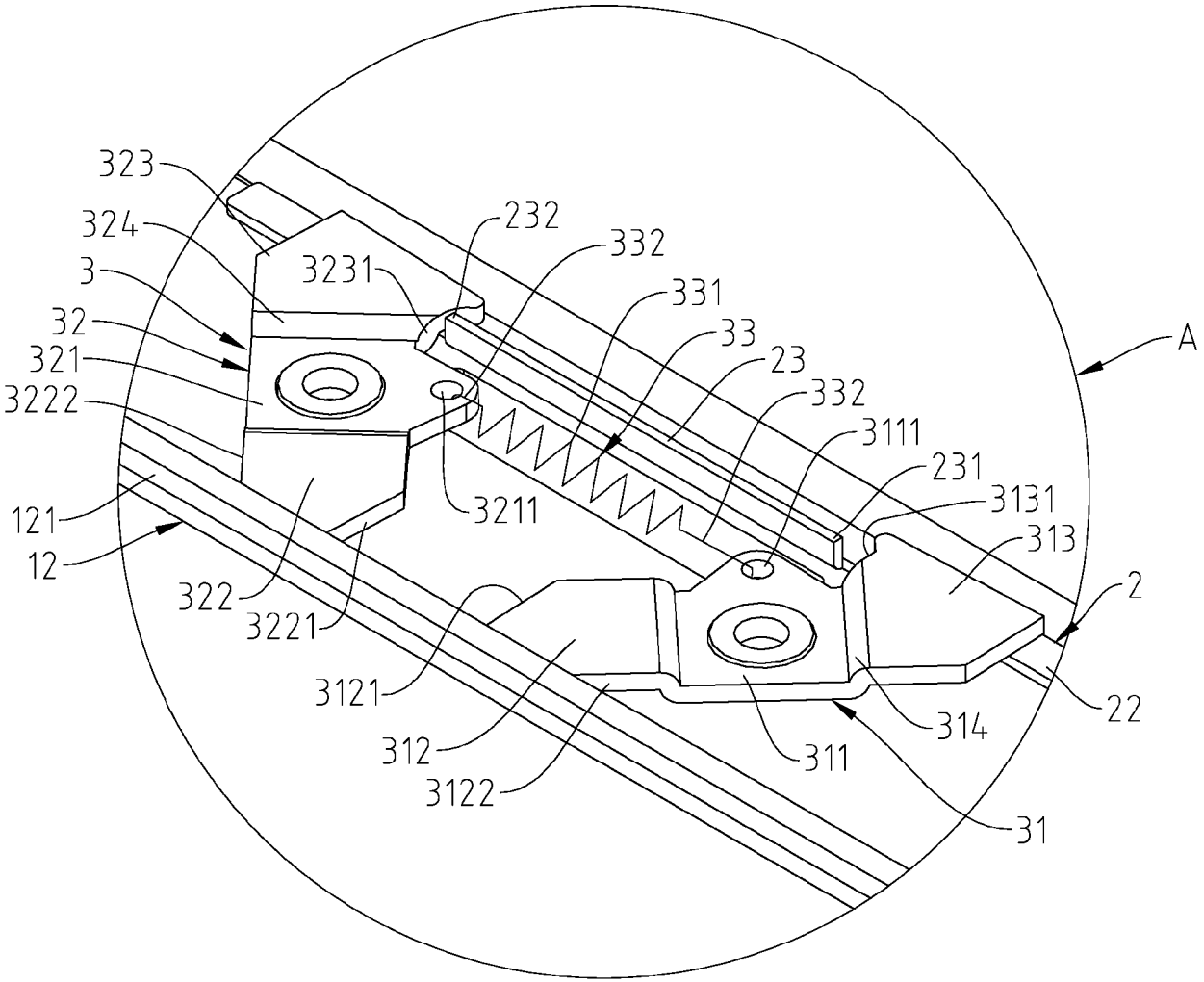
FIG. 4 is an enlarged view of Part A of FIG. 3.

Referring to FIGS. 1-4, a bi-directional positioning sliding rail assembly in accordance with the present invention is shown. The bi-directional positioning sliding rail assembly comprises a sliding rail set 1, an actuator 2 and a position-limiting mechanism 3.

The sliding rail set 1 comprises an outer rail 11, and an inner rail 12 mounted in the outer rail 11 and movable in and out of the outer rail 11 between an extended position and a received position. The outer rail 11 comprises an protruded abutment portion 111 located near one end thereof at one lateral side to face toward the inner rail 12. The inner rail 12 comprises two upright sidewalls 121 respectively and longitudinally extended along two opposite lateral sides thereof, and a positioning rib 122 located on one surface thereof between the two upright sidewalls 121.

The actuator 2 is mounted in the inner rail 12 of the sliding rail set 1 to face toward the outer rail 11. The actuator 2 comprises a base member 21, an elongated position-limiting hole 211 located on the base member 21, an extension member 22 extended from one end of the base member 21, and a push member 23 protruded from a top surface of the extension member 22 and defining a first push end 231 and an opposing second push end 232. The positioning rib 122 of the sliding rail set 1 is coupled to the elongated position-limiting hole 211, and movable with the actuator 2 between two opposite ends of the elongated position-limiting hole 211 to limit the range of movement of the actuator 2.

The position-limiting mechanism 3 is mounted in the inner rail 12 of the sliding rail set 1 to face toward the outer rail 11, comprising a first position-limiting member 31, a second position-limiting member 32 and a spring member 33. The first position-limiting member 31 and the second position-limiting member 32 each comprise a pivot-connection base 311 or 321, a stop block 312 or 322 located at one lateral side of the pivot-connection base 311 or 321, and a position-limiting block 313 or 323 located at an opposite lateral side of the pivot-connection base 311 or 321. The vertical distance d1 between the stop block 312 or 322 and the position-limiting block 313 or 323 is shorter than the distance between the two upright sidewalls 121 of the inner rail 12. The straight line distance d2 between the stop block 312 or 322 and the position-limiting block 313 or 323 is greater than the distance between the two upright sidewalls 121 of the inner rail 12. Further, the pivot-connection base 311 of the first position-limiting member 31 and the pivot-connection base 321 of the second position-limiting member 32 are respectively pivotally connected to the inner rail 12 and spaced from each other at a predetermined distance so that the distance between these two stop blocks 312,322 is shorter than the distance between the two position-limiting blocks 313,323, enabling the first position-limiting member 31 and the second position-limiting member 32 to be kept in an oblique manner relative to each other, and thus, the first position-limiting member 31 can only be biased to move the stop block 312 toward the second position-limiting member 32 and, the second position-limiting member 32 can only be biased to move the stop block 322 toward the first position-limiting member 31. Further, the stop blocks 312 and 322 of the first and second position-limiting members 31 and 32 each define an abutment edge 3121 or 3221 and an opposite guide edge 3122 or 3222. The abutment edge 3121 of the first position-limiting members 31 faces toward the abutment edge 3221 of the second position-limiting member 32. Further, the position-limiting blocks 313 and 323 of the first and second position-limiting members 31 and 32 each further defines a position-limiting notch 3131 or 3231. The position-limiting notch 3131 of the first position-limiting member 31 faces toward the position-limiting notch 3231 of the second position-limiting member 32, The first push end 231 and second push end 232 of the actuator 2 are respectively positioned in the position-limiting notch 3131 of the first position-limiting member 31 and the position-limiting notch 3231 of the second position-limiting member 32. Further, the pivot-connection bases 311 and 321 of the first and second position-limiting members 31 and 32 each define a locating hole 3111 or 3211. The spring member 33 of the position-limiting mechanism 3 comprises an elastically compressible body portion 331, and two hook portion 332 respectively extended from two opposite ends of the elastically compressible body portion 331. The two hook portions 332 are respecctively hooked in the locating holes 3111,3211 of the first and second position-limiting members 31 and 32. Further, the first position-limiting member 31 and the second position-limiting member 32 each further comprise a step portion 314,324 connected between the respective pivot-connection base 311 and 321 and the respective position-limiting block 313 or 323, enabling the position-limiting blocks 313 and 323 of the first and second position-limiting members 31 and 32 to be respecctively supported on the surface of the extension member 22 of the actuator 2.

Figure 5:
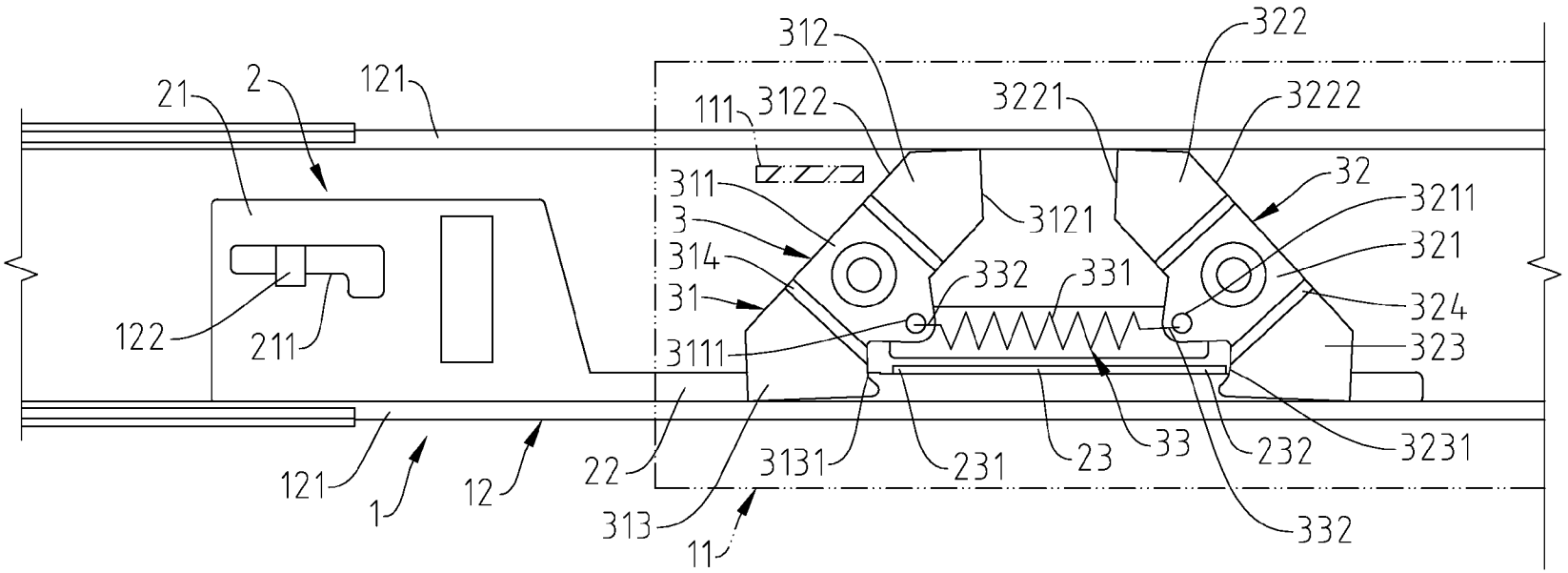
FIG. 5 is a schematic sectional view of the present invention, illustrating an action of the assembly procedure of the inner rail and the outer rail.
Figure 6:
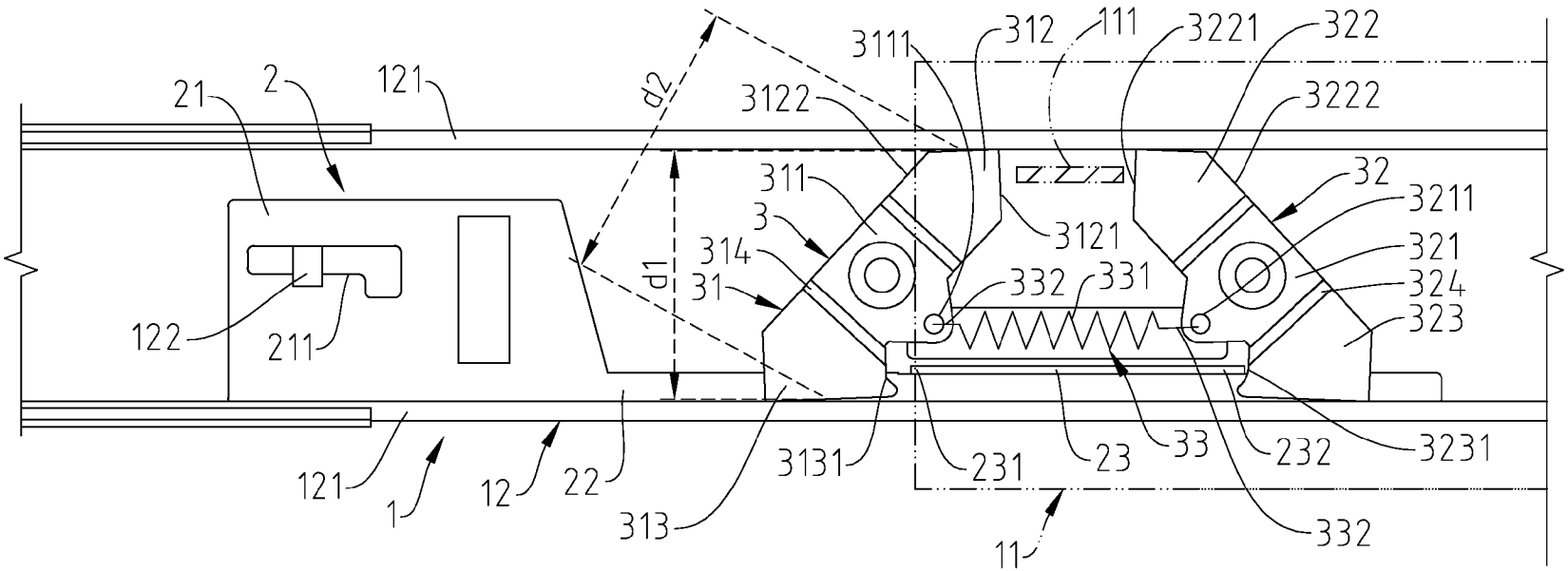
FIG. 6 is a schematic sectional view of the present invention, illustrating the protruded abutment portion entered the first position-limiting member.
Figure 7:
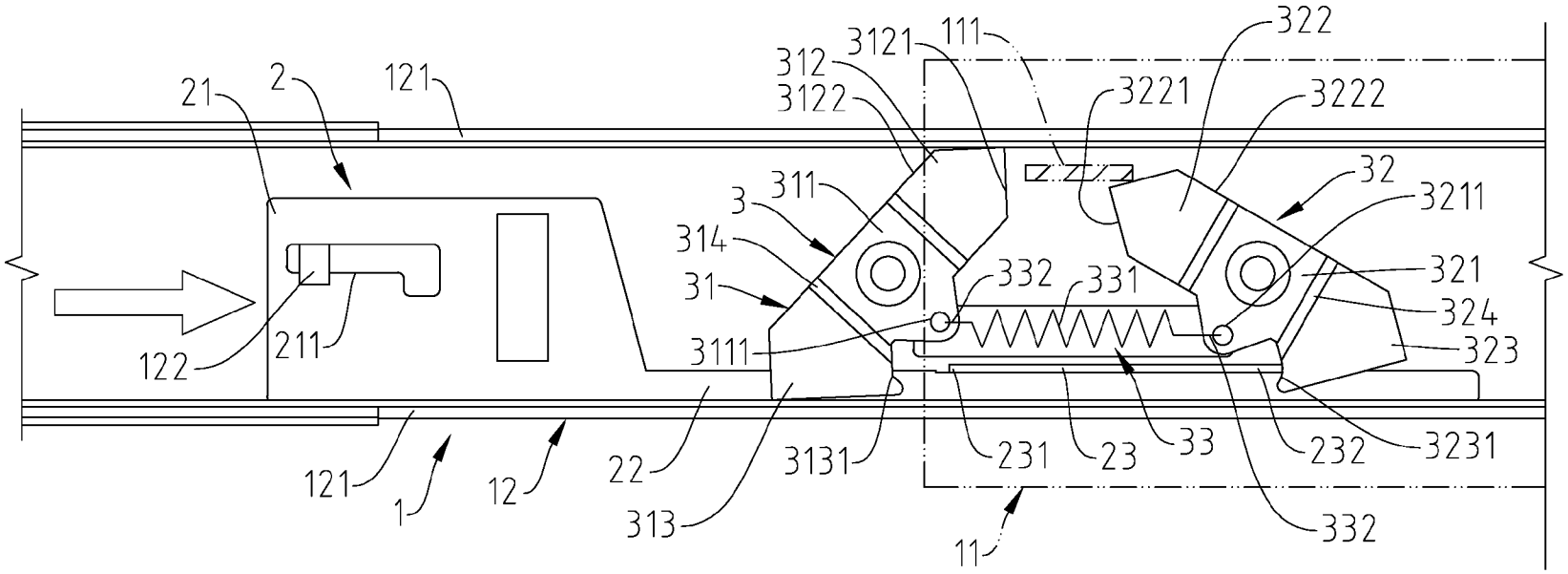
FIG. 7 is a schematic sectional view of the present invention, illustrating the actuator pushed the second position-limiting member.
Figure 8:
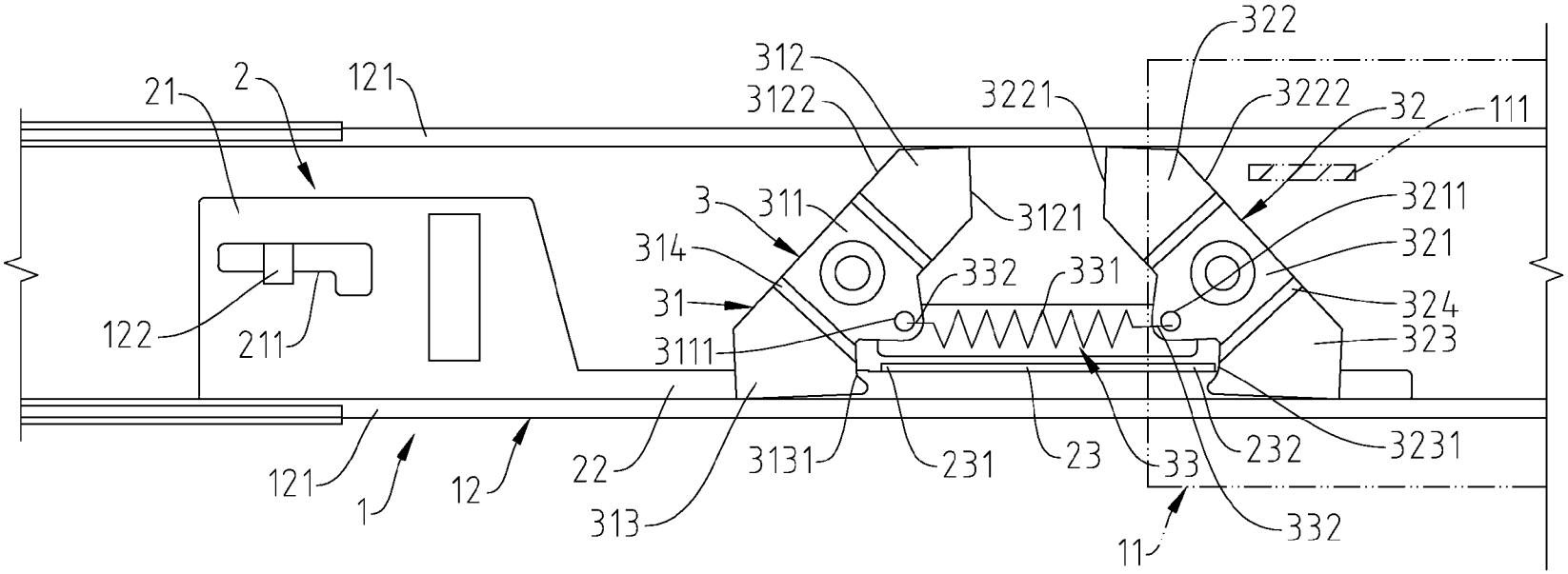
FIG. 8 is a schematic sectional view of the present invention, illustrating the protruded abutment portion moved over the second position-limiting member.
Figure 9:
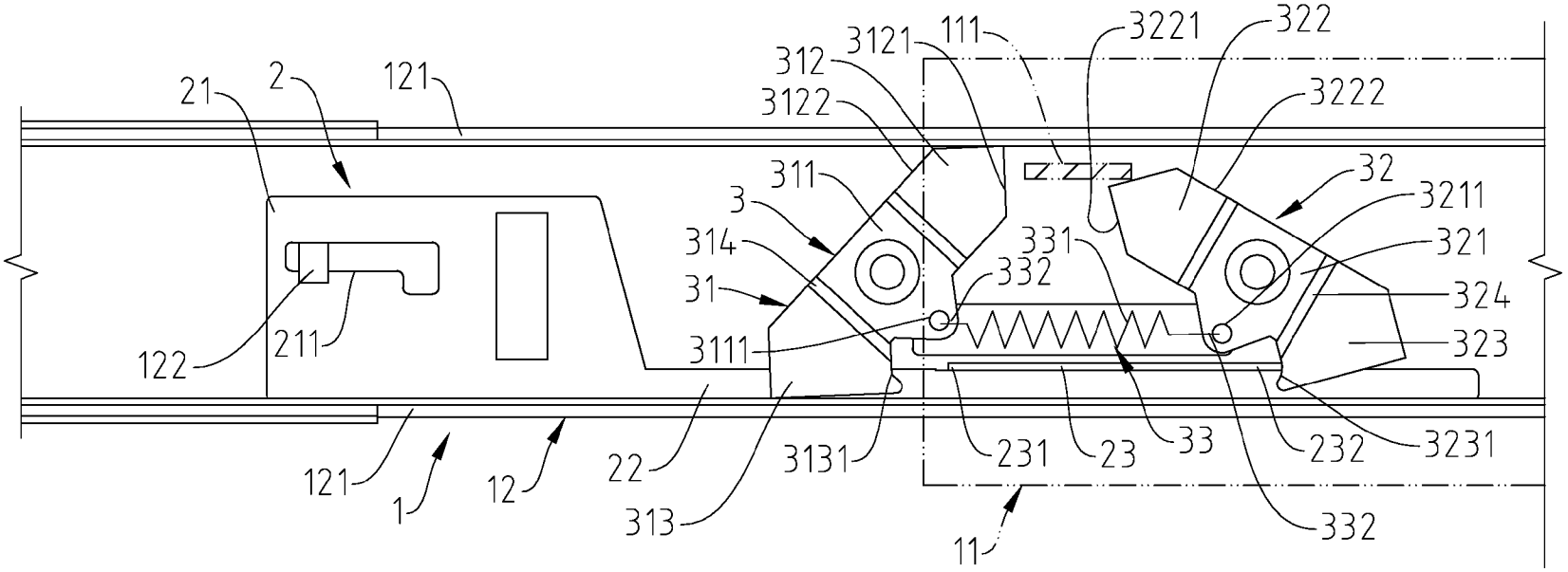
FIG. 9 is a schematic sectional view of the present invention, illustrating the protruded abutment portion pushed the second position-limiting member.
Figure 10:
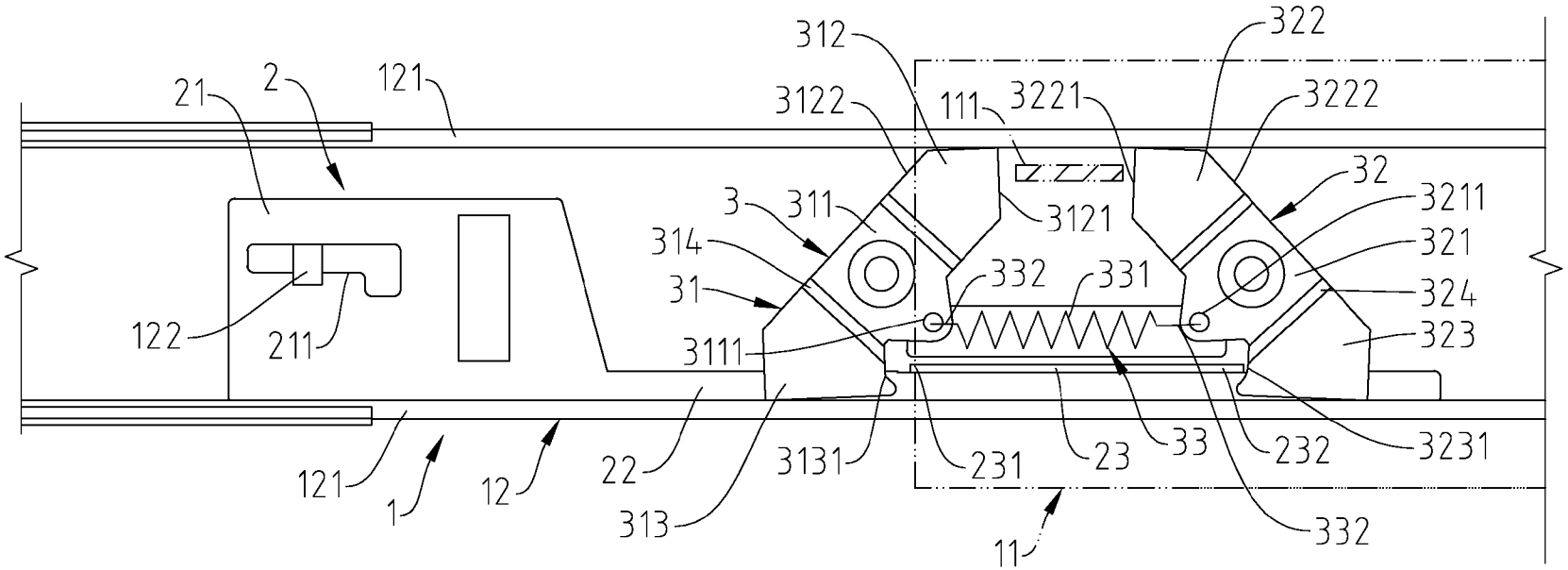
FIG. 10 is a schematic sectional view of the present invention, illustrating the protruded abutment portion entered the second position-limiting member.
Figure 11:
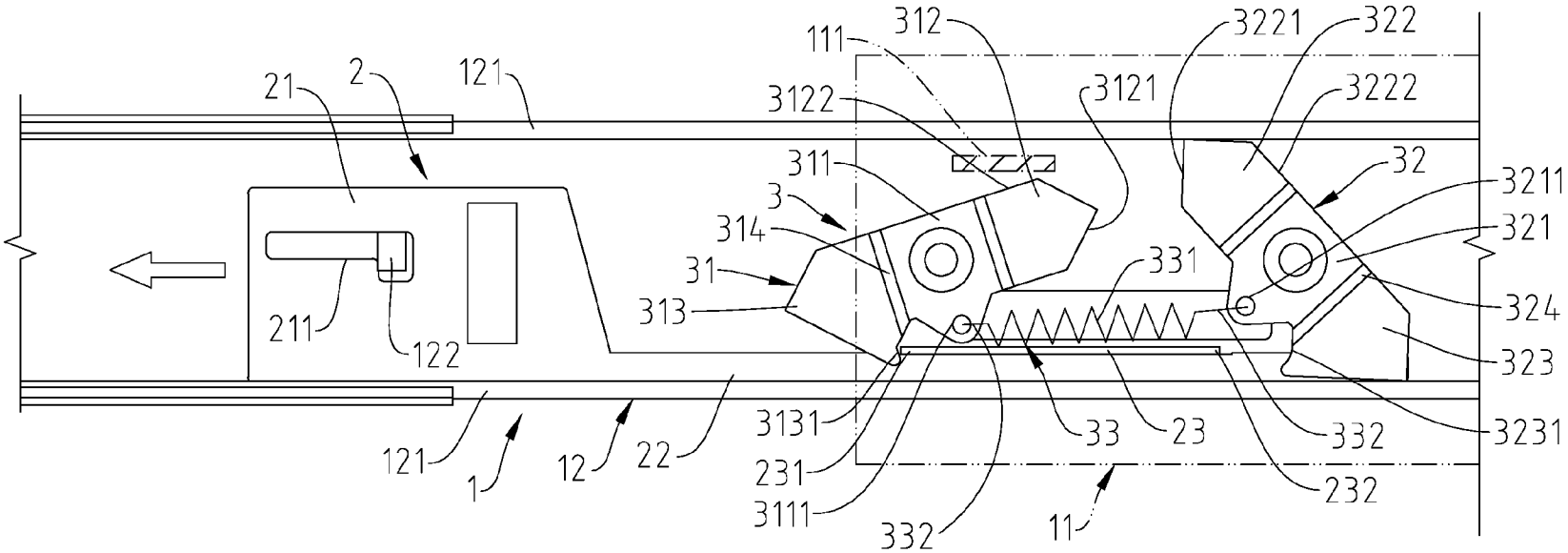
FIG. 11 is a schematic sectional view of the present invention, illustrating the actuator pushed the first position-limiting member.

Referring to FIGS. 5-11, we can see that, from FIGS. 5-8, when assembling the outer rail 11 and inner rail 12 of the sliding rail set 1, the protruded abutment portion 111 is moved inwardly toward the first position-limiting member 31 to push the stop block 312 and to further bias the first position-limiting member 31, causing formation of a gap between the stop block 312 and the adjacent upright sidewall 121 for the passing of the protruded abutment portion 111. The design of the guide edge 3122 facilitates the protruded abutment portion 111 biasing the first position-limiting member 31. Due to the one-way biasing limitation of the first position-limiting member 31 and the second position-limiting member 32, the protruded abutment portion 111 is immediately stopped in place when it gets into the gap between the two abutment edges 3121 and 3221. At this time, the user needs to push the actuator 2 to force the second push end 232 against the position-limiting block 323 of the second position-limiting member 32, causing formation of a gap between the stop block 312 of the second position-limiting member 32 and the adjacent upright sidewall 121 for the passing of the protruded abutment portion 111. Once the protruded abutment portion 111 passed over the stop block 312, the outer rail 11 and the inner rail 12 are well assembled. Further, when biasing the first position-limiting member 31 or second position-limiting member 32, the spring member 33 will be stretched to generate an elastic restoring energy for pulling the first position-limiting member 31 or second position-limiting member 32 back to its previous position when the external biasing force is disappeared. Further, the first position-limiting member 31 and the second position-limiting member 32 are respectively kept in position by means of abutment of the respective stop blocks 312 and 322 against one upright sidewall 121. On the contrary, when detaching the outer rail 11 and inner rail 12 of the sliding rail set 1, as illustrated in FIGS. 8-11, force the protruded abutment portion 111 to bias the second position-limiting member 32, causing the actuator 2 to bias the first position-limiting member 31. This operating action is similar to the operating action in assembling the outer rail 11 and the inner rail 12 with an exception of the direction, and therefore, it is not necessary to repeat them.

What the invention claimed is:

1. A bi-directional positioning sliding rail assembly, comprising:

a sliding rail set comprising an outer rail and an inner rail movable in and out of said outer rail, said outer rail comprising a protruded abutment portion located near one end thereof at one lateral side and facing toward said inner rail, said inner rail comprising two upright sidewalls longitudinally extended along two opposite lateral sides thereof;

an actuator mounted in said inner rail of said sliding rail set to face toward said outer rail, said actuator comprising a base member, an extension member extended from one end of said base member and a push member protruded from a top surface of said extension member and defining a first push end and an opposing second push end; and a position-limiting mechanism mounted in said inner rail of said sliding rail set to face toward said outer rail, comprising a first position-limiting member, a second position-limiting member and a spring member, said first position-limiting member and said second position-limiting member each comprising a pivot-connection base, a stop block located at one side of said pivot-connection base and a position-limiting block located at an opposite side of said pivot-connection base, the vertical distance between said stop block and said position-limiting block being shorter than the distance between the two said upright sidewalls of said inner rail, the straight line distance between said stop block and said position-limiting block being greater than the distance between the two said upright sidewalls of said inner rail, the said pivot-connection base of said first position-limiting member and the said pivot-connection base of said second position-limiting member being respectively pivotally connected to said inner rail and spaced from each other at a predetermined distance, the distance between the said stop block of said first position-limiting member and the said stop block of said second position-limiting member being shorter than the distance between the said position-limiting block of said first position-limiting member and the said position-limiting of said second position-limiting member, the said position-limiting block of said first position-limiting member and the said position-limiting block of said second position-limiting member respectively facing toward said first push end and said second push end of said actuator, said spring member having two opposite ends thereof respectively connected to the said pivot-connection base of said first position-limiting member and the said pivot-connection base of said second position-limiting member.

2. The bi-directional positioning sliding rail assembly as claimed in claim 1, wherein the said pivot-connection bases of said first position-limiting member and said second position-limiting member each define therein a locating hole; said spring member of said position-limiting mechanism comprises an elastically compressible body portion, and two hook portions respectively extended from two opposite ends of said elastically compressible body portion and respectively hooked in the said locating hole of said first position-limiting member and the said locating hole of said second position-limiting member.

3. The bi-directional positioning sliding rail assembly as claimed in claim 1, wherein said first position-limiting member and said second position-limiting member each further comprise a step portion connected between the respective said pivot-connection base and the respective said position-limiting block for enabling the two said position-limiting blocks of said first position-limiting member and said second position-limiting member to be supported on said extension member of said actuator.

4. The bi-directional positioning sliding rail assembly as claimed in claim 1, wherein said first position-limiting member and second position-limiting member each further comprises a position-limiting notch located on the respective said position-limiting block; said first push end and said second push end of said actuator are respectively positioned in the said position-limiting notches of said first position-limiting member and said second position-limiting member.

5. The bi-directional positioning sliding rail assembly as claimed in claim 1, wherein the said stop block of said first position-limiting member and the said stop block of said second position-limiting member each comprise an abutment edge and an opposing guide edge, the said abutment edge of the said stop block of said first position-limiting member being disposed to face toward the said abutment edge of the said stop block of said second position-limiting member.

* * * * *